US009534528B2

(12) United States Patent
Osburg et al.

(10) Patent No.: US 9,534,528 B2
(45) Date of Patent: Jan. 3, 2017

(54) INTERNAL COMBUSTION ENGINE WITH FUEL SYSTEM

(71) Applicant: Andreas Stihl AG & Co. KG, Waiblingen (DE)

(72) Inventors: Gerhard Osburg, Kernen (DE); Clemens Klatt, Winnenden (DE); Tobias Leopold, Zusmarshausen (DE); Michael Dietenberger, Waiblingen (DE); Wolfgang Layher, Besigheim (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 558 days.

(21) Appl. No.: 13/707,832

(22) Filed: Dec. 7, 2012

(65) Prior Publication Data

US 2013/0340722 A1 Dec. 26, 2013

(30) Foreign Application Priority Data

Dec. 7, 2011 (DE) ..... 10 2011 120 465

(51) Int. Cl.

| | |
|---|---|
| ***F02M 1/00*** | (2006.01) |
| ***F02B 15/00*** | (2006.01) |
| ***F02M 1/16*** | (2006.01) |
| ***F02M 37/00*** | (2006.01) |
| ***F02M 37/16*** | (2006.01) |
| ***F02M 37/18*** | (2006.01) |
| ***F02M 37/20*** | (2006.01) |
| ***F02M 69/10*** | (2006.01) |

(52) U.S. Cl.

CPC ..... *F02B 15/00* (2013.01); *F02M 1/16* (2013.01); *F02M 37/007* (2013.01); *F02M 37/0023* (2013.01); *F02M 37/0029* (2013.01); *F02M 37/16* (2013.01); *F02M 37/18* (2013.01); *F02M 37/20* (2013.01); *F02M 69/10* (2013.01)

(58) Field of Classification Search

CPC ..... F02M 37/0052
USPC ..... 123/509, 516, 179.9, 179.11, 179.16,123/179.17

See application file for complete search history.

(56) References Cited

U.S. PATENT DOCUMENTS

| | | | | |
|---|---|---|---|---|
| 3,805,758 | A | 4/1974 | May | |
| 4,205,637 | A | 6/1980 | Ito et al. | |
| 4,253,433 | A | 3/1981 | Blair | |
| 4,383,513 | A * | 5/1983 | Gmelin et al. | 123/454 |
| 4,438,733 | A | 3/1984 | Sasaki | |
| 4,596,219 | A | 6/1986 | Kemmner | |

(Continued)

FOREIGN PATENT DOCUMENTS

| | | |
|---|---|---|
| CA | 2251764 A1 | 10/1997 |
| CN | 1 497 158 A | 5/2004 |

(Continued)

*Primary Examiner* — John Kwon
(74) *Attorney, Agent, or Firm* — Gudrun E. Huckett

(57) ABSTRACT

An internal combustion engine has a fuel system that has a fuel valve with a housing, wherein in the housing a fuel chamber is formed. A fuel pump pumps fuel from a fuel tank into the fuel chamber. A conveying pump provides forced conveyance of fuel into the fuel system. A feed line is connected to the fuel chamber of the fuel valve. The conveying pump is arranged in the feed line and supplies fuel to the fuel chamber. A relief line is connected to the fuel chamber of the fuel valve and a first valve is arranged in the relief line.

18 Claims, 5 Drawing Sheets

(56) References Cited

U.S. PATENT DOCUMENTS

| | | | | | |
|---|---|---|---|---|---|
| 4,608,957 | A | | 9/1986 | Kemmner | |
| 4,903,655 | A | | 2/1990 | Vonderau et al. | |
| 4,971,016 | A | * | 11/1990 | Peters et al. | 123/500 |
| 5,042,445 | A | * | 8/1991 | Peters et al. | 123/446 |
| 5,142,934 | A | | 9/1992 | Persson et al. | |
| 5,201,288 | A | | 4/1993 | Döragrip | |
| 5,207,203 | A | * | 5/1993 | Wagner et al. | 123/514 |
| 5,419,686 | A | | 5/1995 | Wissmann et al. | |
| 5,488,933 | A | | 2/1996 | Pham | |
| 5,526,843 | A | | 6/1996 | Wolf et al. | |
| 5,664,532 | A | | 9/1997 | August | |
| 5,673,670 | A | | 10/1997 | Powell et al. | |
| 5,699,761 | A | | 12/1997 | Yamaguchi et al. | |
| 5,727,506 | A | | 3/1998 | Tajima et al. | |
| 5,899,179 | A | | 5/1999 | Sasaki et al. | |
| 5,934,257 | A | | 8/1999 | Ishikawa et al. | |
| 5,967,120 | A | | 10/1999 | Blanton et al. | |
| 6,135,071 | A | | 10/2000 | Kobayashi et al. | |
| 6,196,170 | B1 | | 3/2001 | Singer et al. | |
| 6,701,900 | B1 | | 3/2004 | Millar et al. | |
| 6,938,884 | B2 | | 9/2005 | Knaus et al. | |
| 7,325,528 | B2 | | 2/2008 | Schieber et al. | |
| 7,552,714 | B2 | | 6/2009 | Maier et al. | |
| 7,743,751 | B2 | | 6/2010 | Yonemoto | |
| 7,909,022 | B2 | | 3/2011 | Kato et al. | |
| 2004/0168656 | A1 | | 9/2004 | Carlsson et al. | |
| 2009/0007892 | A1 | | 1/2009 | Burkitt | |
| 2009/0114189 | A1 | | 5/2009 | Shafer et al. | |
| 2010/0186724 | A1 | | 7/2010 | Ranganathan et al. | |
| 2010/0196179 | A1 | | 8/2010 | Noguchi | |
| 2011/0140707 | A1 | | 6/2011 | Böker et al. | |

FOREIGN PATENT DOCUMENTS

| | | | |
|---|---|---|---|
| CN | 1 989 322 | A | 6/2007 |
| DE | 197 32 741 | A1 | 7/1997 |
| EP | 0 280 923 | A2 | 9/1988 |
| EP | 0 440 401 | A1 | 8/1991 |
| EP | 1 403 496 | B1 | 3/2004 |
| EP | 1 614 901 | A1 | 1/2006 |
| EP | 1 772 221 | A1 | 4/2007 |
| EP | 1 775 442 | A1 | 4/2007 |
| GB | 885 152 | A | 12/1961 |
| GB | 2 165 003 | A | 4/1986 |
| JP | S59162353 | | 9/1984 |
| JP | H01318757 | | 12/1989 |
| JP | 03-87866 | | 9/1991 |
| JP | H07208289 | | 8/1995 |
| JP | H08303330 | | 11/1996 |
| JP | 2008 045489 | A | 2/2008 |
| WO | 2005/025822 | A1 | 3/2005 |
| WO | 2011/142859 | A1 | 11/2011 |

* cited by examiner

INTERNAL COMBUSTION ENGINE WITH FUEL SYSTEM

BACKGROUND OF THE INVENTION

The invention relates to an internal combustion engine with a fuel system, wherein the fuel system comprises a fuel valve, wherein the fuel valve has a housing in which a fuel chamber is formed. The fuel system comprises a fuel pump that conveys fuel from the fuel tank into the fuel chamber. The fuel system has a conveying pump for forced conveyance of fuel into the fuel system.

It is known to provide a conveying pump in fuel systems that operate with a carburetor, wherein the conveying pump is operated manually and primes the fuel system before starting the internal combustion engine, for example, after a longer shutdown period of the internal combustion engine. Such systems operate usually by suction. In such a system, the fuel is sucked in through the control chamber of the carburetor by the conveying pump that is arranged downstream of the carburetor. Such a system is disclosed, for example, in U.S. Pat. No. 6,938,884.

In fuel systems that comprise a fuel valve, it can be provided also that the fuel system is primed prior to starting the engine. Such a fuel system is disclosed in U.S. Pat. No. 7,743,751. In this fuel system, by means of a conveying pump fuel is forced through a portion of the fuel system back into the fuel tank. In this way, the fuel system is primed. The fuel system disclosed in U.S. Pat. No. 7,743,751 has a high-pressure pump that conveys the fuel to the injection valve. The part of the fuel system in which the high-pressure pump is arranged is not primed by the conveying pump.

The invention has the object to provide an internal combustion engine with a fuel system of the aforementioned kind in which excellent starting behavior of the internal combustion engine is achieved.

SUMMARY OF THE INVENTION

In accordance with the present invention, this is achieved in that the internal combustion engine with the fuel system is provided with a conveying pump that is arranged in a feed line to the fuel chamber of the fuel valve and conveys fuel into the fuel chamber and in that the fuel chamber is connected to a relief line in which a first valve is arranged.

It has been found that in fuel systems with a fuel valve, vapor bubble formation in the fuel system and in the injection valve makes it very difficult to start the internal combustion engine, or even prevents starting the engine. The vapor bubble formation is a problem primarily in fuel systems that operate at minimal pressure, for example, a pressure of only one or several tenth of a bar, or a few bar, above ambient pressure. The pressure in such a fuel system can be, for example, approximately 100 mbar above ambient pressure. When the fuel valve heats up too much, vapor bubbles can form in the fuel valve. The vapor bubble formation is in particular also a problem when the internal combustion engine is shut off and after-heating occurs because no cooling air is conveyed anymore.

In order to flush out vapor bubbles that are formed within the fuel system, it is provided that the conveying pump is arranged in a feed line into the fuel chamber of the fuel valve and conveys the fuel into the fuel chamber of the fuel valve. The fuel chamber is connected with a relief line in which a first valve is arranged. Since the fuel chamber of the fuel valve is flushed or primed, it is ensured that vapor bubbles in the fuel system are flushed out. At the same time, by priming the fuel valve with fuel, an effective cooling action of the fuel valve is achieved in a simple way and this prevents new vapor bubbles from being formed. By means of the first valve that is arranged in the relief line, the desired pressure in the fuel system can be maintained in operation. Depending on the control action and configuration of the first valve, priming of the fuel chamber in the injection valve can be done at a pressure significantly higher than operating pressure in the fuel system. In this way, an effective priming action and removal of gas or vapor bubbles, possibly contained in the fuel chamber, is enabled and this prevents new vapor bubbles from being formed.

A simple configuration results when the feed line in which the conveying pump is arranged is positioned in the flow path from a pump chamber of the fuel pump into the fuel chamber. The conveying pump can therefore be arranged in a feed line of the fuel system that is existing anyway. Advantageously, a pressure regulator is arranged downstream of the fuel pump. The feed line in which the conveying pump is arranged connects a control chamber of the pressure regulator with the fuel chamber. Since the conveying pump is arranged downstream of the pressure regulator, the pressure regulator does not act to limit the pressure that is supplied by the conveying pump for priming the fuel valve so that by means of the conveying pump a fuel pressure can be generated in the fuel system that is significantly higher than the fuel pressure that is conventionally existing in operation. However, it can also be provided that the feed line is a bypass line bypassing the fuel pump and connecting the fuel tank with the fuel chamber. As a result of the arrangement of the fuel pump in a bypass line bypassing the fuel pump, the spatial arrangement of the conveying pump relative to the fuel pump and the internal combustion engine can be substantially freely selected.

Advantageously, the first valve is actuated as a function of a pressure, i.e. is opened or closed by pressure control. The actuating pressure at which, when it is surpassed, the first valve opens is advantageously higher than the operating pressure of the fuel system. Accordingly, by means of the conveying pump a limited overpressure can be generated in the fuel system relative to normal operating pressure. In this way, it is prevented that new vapor bubbles can form in the fuel valve of the fuel system. The valve can open in particular as a function of the pressure in the fuel chamber or as a function of the pressure difference between fuel chamber and fuel tank. As an alternative or in addition, it can be provided that the valve is actuated as a function of temperature. The actuating temperature can be, for example, the temperature of the fuel valve or of the internal combustion engine. It can also be provided that the valve opens and closes as a function of the engine speed of the internal combustion engine. In this context, it is in particular provided that the valve is closed above a predetermined actuating engine speed so that the first valve in usual operation is closed and is open only during the starting process. It can also be provided that the first valve is closed once the first combustion cycle has been detected. The first combustion cycle can be, for example, detected based on the engine speed of the internal combustion engine. The actuating engine speed at which the valve is closed can be an engine speed that is reached as soon as the internal combustion engine has started and that is, however, below the idle speed of the internal combustion engine. As an alternative or in addition, it can be provided that the valve is actuated by time control. The first valve closes in this connection advantageously after lapse of a predetermined time span, for example, the time for one or several pull strokes for starting the engine. In this way, the fuel system is primed during the starting procedure. The different parameters for actuating the first valve can be combined in a suitable way.

A simple configuration results when the valve is a pressure retention valve that opens in the relief direction. The pressure retention valve operates mechanically so that for control of the pressure retention valve no additional devices are required. Since the first valve opens only in the relief direction, opening in the direction opposite to the relief direction, i.e., in the flow direction from the fuel tank to the fuel chamber, is prevented, for example, when in the fuel tank a higher pressure exists than in the fuel chamber. This is the case in particular in fuel systems in which the fuel tank is loaded with pressure. Advantageously, the first valve is an electrically actuated valve. The internal combustion engine has in particular an electronic control unit that actuates the first valve. In this way, an advantageous control of the first valve can be achieved that in particular takes into consideration several parameters.

It can be provided that a second valve is arranged in a bypass line bypassing the first valve. Advantageously, the second valve is a pressure retention valve while the first valve is an electrically actuated valve. By means of the pressure retention valve that is arranged in the bypass line, independent of the parameters that are used for actuating the first valve, it can be ensured that pressure in the fuel system does not rise impermissibly.

The conveying pump can be driven manually, mechanically, electrically or pneumatically. The mechanical drive is realized advantageously by means of a component of the internal combustion engine. The pneumatic drive is advantageously done by means of the fluctuating pressure in the internal combustion engine, in particular in the crankcase of the internal combustion engine.

DESCRIPTION OF THE PREFERRED EMBODIMENTS

Figure 1:
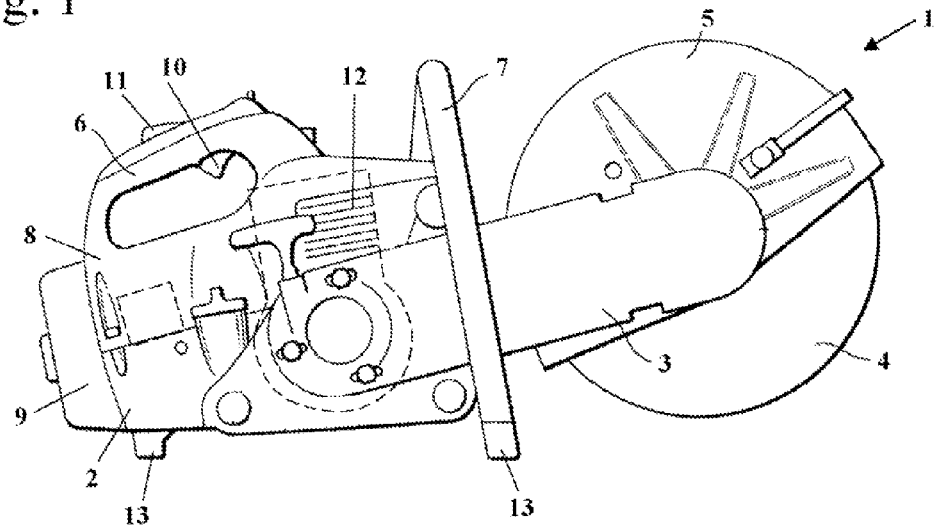
FIG. 1 is a schematic side view of a cut-off machine with an internal combustion engine.

FIG. 1 shows an embodiment of a hand-guided power tool in the form of a cut-off machine 1. Instead of being used in the cut-off machine 1, the fuel system according to the invention can also be used in connection with other hand-guided power tools such as trimmers, motor chainsaws, blowers and the like. The cut-off machine 1 has a housing 2 in which an internal combustion engine 12 is arranged. On the housing 2, a cantilever arm 3 is secured that has at its free end a cutter wheel 4. The cutter wheel 4 is partially covered by a protective cover 5. The cutter wheel 4 is rotatingly driven by the internal combustion engine 12. For guiding the internal combustion engine 1, a top handle 6 as well as grip pipe (handlebar) 7 are provided. The handlebar 7 spans the housing 2 at the front side that is facing the cutter wheel 4. The top handle 6 is integrally formed on a hood 8 of the housing 2. On the top handle 6 a throttle trigger 10 and a throttle lock 11 are pivotably supported. At the rear of the housing 2 that is facing away from the cutter wheel 4 an air filter cover 9 is arranged. The cut-off machine 1 has several support legs 13 with which the cut-off machine 1 can be placed onto a support surface.

Figure 2:
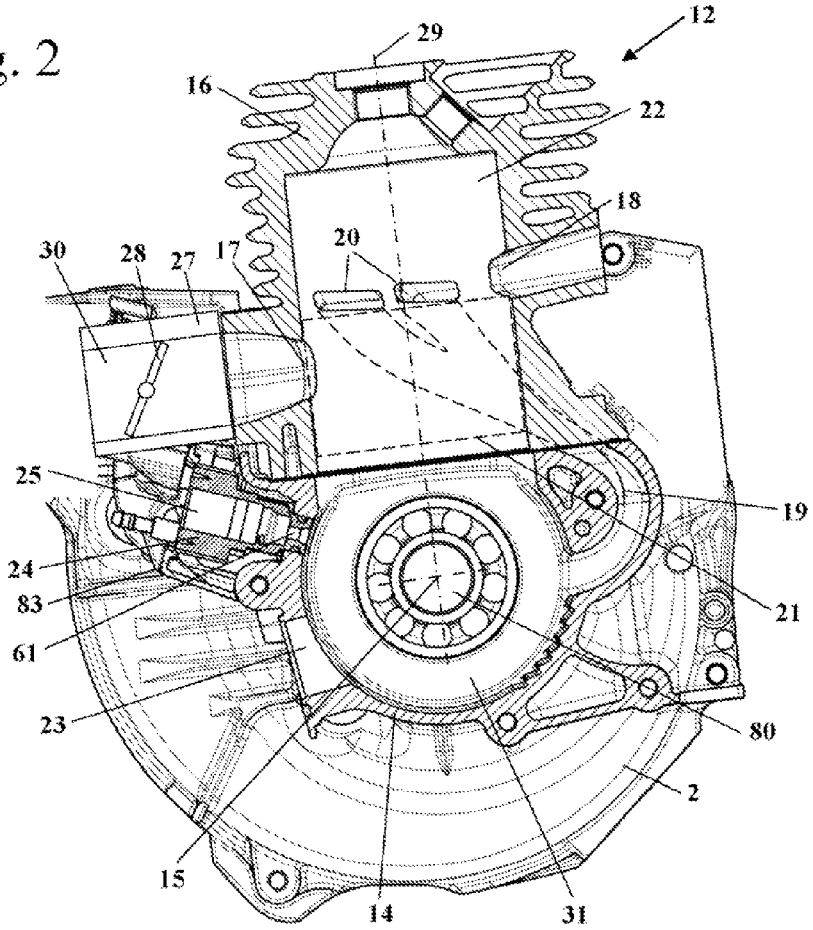
FIG. 2 is a partially schematic section illustration of the internal combustion engine of the cut-off machine of FIG. 1.

FIG. 2 shows the internal combustion engine 12 in detail. The internal combustion engine 12 is a single-cylinder engine and is embodied as a two-stroke engine in the illustrated embodiment. The internal combustion engine 12 has a crankcase 14 in which a crankshaft 80 is supported so as to be rotatable about axis of rotation 15. On the crankcase 14 a cylinder 16 is secured in which piston 21, schematically indicated in FIG. 2, is reciprocatingly supported in the direction of a longitudinal cylinder axis 29. The piston 21 drives by means of a connecting rod, not illustrated, a crankshaft 80 in rotation. The piston 21 delimits a combustion chamber 22 that is formed in the cylinder 16. For supplying combustion air, the internal combustion engine 12 has an intake passage 30 which opens with an inlet 17 at the cylinder 16. The inlet 17 is piston-controlled by the piston 21 and, when the piston 21 is at top dead center, is open relative to the crankcase interior 31. The inlet 17 is always closed relative to the internal combustion engine 22. A section of the intake passage 30 is extending through the throttle housing 27 in which a throttle element is arranged. In the illustrated embodiment, the throttle element is a pivotably supported throttle flap 28. The throttle flap 28 is actuated by the throttle trigger 10 and serves for controlling the quantity of combustion air supplied to the engine.

Figure 5:
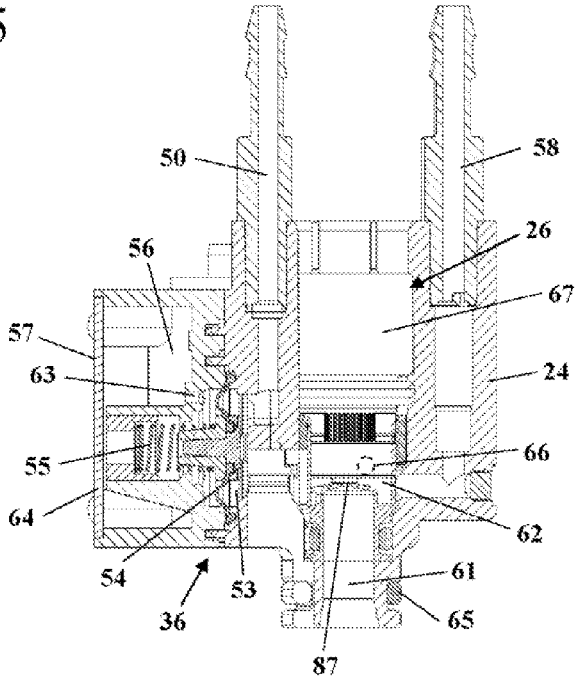
FIG. 5 is a section view of a holder of the fuel system.

On the crankcase 14 a holder 24 is attached that has a receptacle 25 for the fuel valve 26 illustrated in FIG. 5. The holder 24 has a fuel passage 61 by means of which the fuel that is metered in by the fuel valve 26 is supplied into the crankcase interior 31. The holder 24 is partially enclosed by an air guiding component 83 that guides air from a fan wheel housing to the holder 24 and in this way contributes to cooling of the fuel valve 26. The crankcase 14 has also a mounting opening 23 in which a sensor, in particular a pressure sensor, a temperature sensor or a combined pressure and temperature sensor can be arranged.

When the piston 21 is in the area of bottom dead center, the crankcase interior 31 communicates by means of a transfer passage 19 with the combustion chamber 22. In the illustrated embodiment, a single transfer passage 19 is provided that branches into several branch passages and opens with several transfer ports 20 into the combustion chamber 22. The transfer ports 20 are piston-controlled by the piston 21 and open when the piston 21 is at bottom dead center. An outlet 18 that is also controlled by the piston 21 extends away from the combustion chamber 22.

In operation, through the intake passage 30 combustion air is supplied into the crankcase interior 31. Fuel is metered into the crankcase interior 31 by means of fuel valve 26 (FIG. 5). The fuel/air mixture that is formed in the crankcase interior 31 flows through the transfer passage or transfer passages 19 into the combustion chamber 22 when the piston 21 is at bottom dead center. Upon upward stroke of the piston 21, the fuel/air mixture in the combustion chamber 22 is compressed and, when the piston 21 is at top dead center, is ignited by a spark plug, not illustrated. As a result of combustion in the combustion chamber 22, the piston 21 is accelerated in the direction of bottom dead center. As soon as the outlet 18 has been released by the piston 21, the exhaust gases escape through outlet 18 from the combustion chamber 22. Through the transfer ports 20 fresh fuel/air mixture from the crankcase interior 31 flows into the combustion chamber 22 as soon as the ports 20 have been released by the downwardly moving piston 21.

Figure 3:
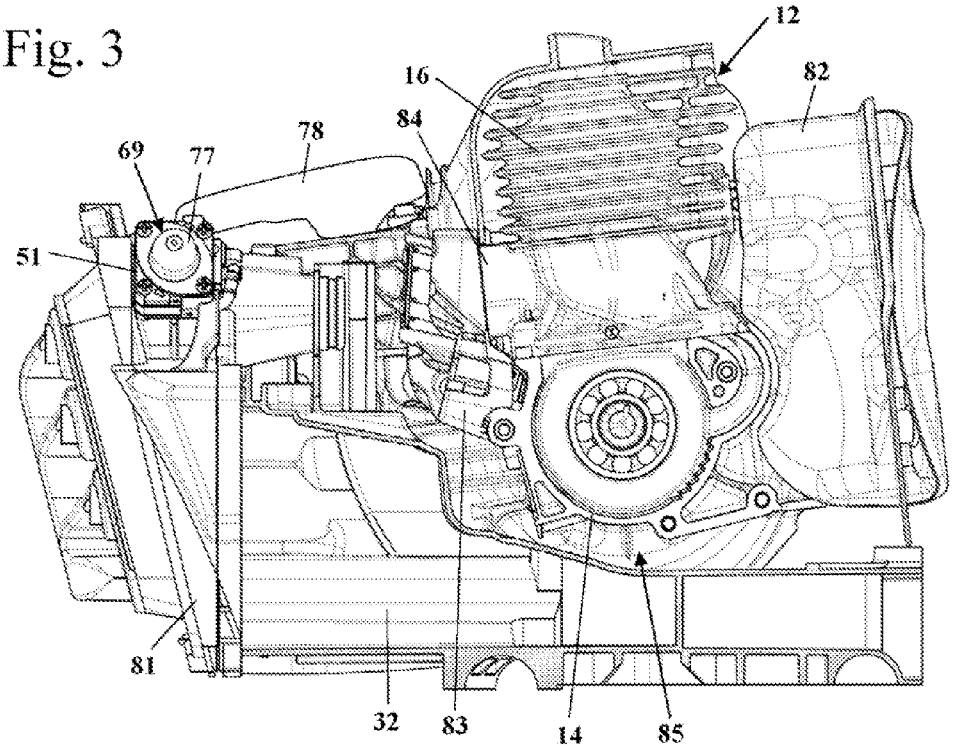
FIG. 3 is a side view, partially sectioned, of a detail of the cut-off machine of FIG. 1.

As shown in FIG. 3, an exhaust gas muffler 82 is arranged at the internal combustion engine 12 into which the exhaust gases exiting through the outlet 18 are flowing. FIG. 3 shows also the arrangement of the air guiding component 83 on the crankcase 14. The air guiding component 83 is arranged immediately below an inlet socket 84 of the internal combustion engine 12. The intake passage 30 extends within the inlet socket 84 up to the inlet 17.

As also shown in FIG. 3, the cut-off machine 1 has a tank housing 81 that is separated from the internal combustion engine 12 by means of a vibration gap 85. The vibration gap 85 is bridged by an elastic intake socket (not illustrated in FIG. 3) in which the intake passage 30 is extending across the vibration gap 85. The vibration gap 85 is also bridged by several antivibration elements that are also not illustrated. In the tank housing 81 a fuel tank 32 is formed. On the tank housing 81 a pump housing 51 of a fuel pump 34 (FIG. 4) is secured. In the pump housing 51 a conveying pump 69 is integrated that is embodied as a manual conveying pump and that has a pump bellows 77 that is to be actuated by the operator. The pump bellows 77 projects from the housing 2 so that it can be accessed easily by the operator.

The internal combustion engine 12 has an electronic control unit 78 that controls the fuel valve 26, i.e., the fuel quantity that is to be supplied and the point in time when the fuel quantity is to be supplied. The electronic control unit 78 controls also the ignition timing. Also, further electrical components of the cut-off machine 1 can be controlled by the electronic control unit 78.

Figure 4:
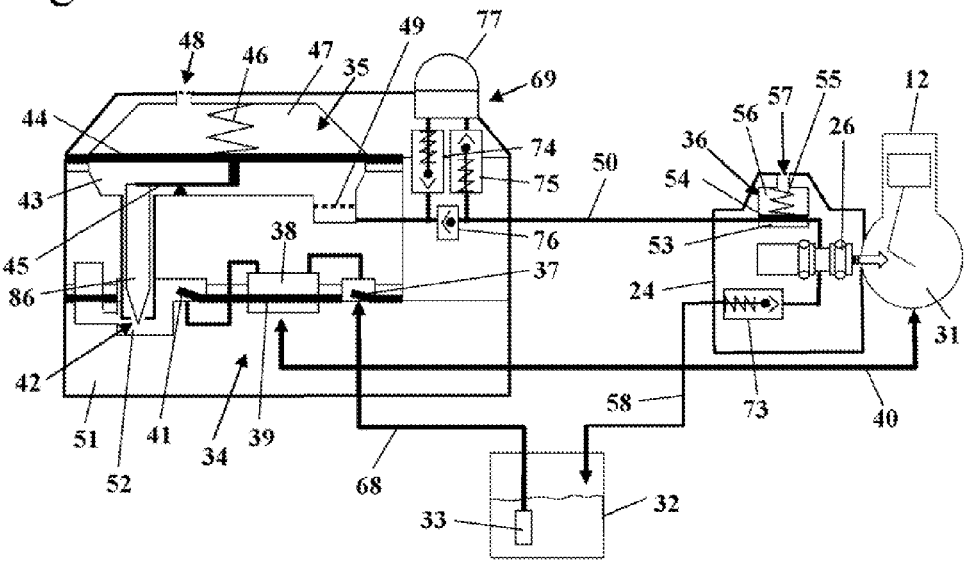
FIG. 4 is a schematic illustration of the fuel system of the internal combustion engine.

FIG. 4 shows schematically the fuel system of the internal combustion engine 12. In the fuel tank 32 a suction head 33 is positioned that is connected by means of fuel line 68 with the fuel pump 34 that is formed in the pump housing 51. The fuel pump 34 sucks in fuel through intake valve 37 into a pump chamber 38. The pump chamber 38 is delimited by a pump membrane 39. The back of the membrane 39 communicates by an impulse line 40 with the crankcase interior 31. Because of the fluctuating pressure in the crankcase interior 31 that fluctuates as a result of the reciprocating movement of the piston 21, the pump membrane 39 is moved and conveys therefore fuel to a pressure valve 41. The intake valve 37 and the pressure valve 41 are designed as check valves. The fuel passes through pressure valve 41 into a storage chamber 52 that is connected by means of an inlet valve 42 with a control chamber 43 of a pressure regulator 35. The pressure regulator 35 is also formed in the pump housing 51. However, a separate housing for the pressure regulator 35 may be provided instead. The inlet valve 42 has a valve needle 86 that is connected by means of a lever 45 with a control membrane 44 that delimits the control chamber 43. On the side of the control membrane 44 that is facing away from the control chamber 43, a back chamber 47 is formed. The control membrane 44, as shown in the embodiment, can be pretensioned by a spring 46. The spring 46 is advantageously in the form of a pressure spring and is arranged in the back chamber 47. The back chamber 47 is advantageously loaded through opening 48 with a reference pressure. The reference pressure is advantageously ambient pressure. When the pressure in the control chamber 43 is lower than the desired pressure of the fuel system, the control membrane 44 is deflected in the direction toward the control chamber 43 and opens thereby by means of the lever 45 the inlet valve 42. When the pressure increases to the pressure of the fuel system that is adjusted by means of the spring stiffness of the control membrane 44 and of the spring 46, the control membrane 44 is returned into its initial position and closes the inlet valve 42. The control chamber 43 is connected by feed line 50 with a damper chamber 53 of a fuel pressure damper 36. Instead, the control chamber 43 can be connected by feed line 50 directly with the fuel valve 26. The fuel passes through a fuel screen 49 arranged in the control chamber 43 into the feed line 50.

The fuel pressure damper 36 as well as the fuel valve 26 are arranged in the holder 24. The fuel pressure damper 36 has a damper membrane 54 that delimits the damper chamber 53. At the side of the damper membrane 54 that is facing away from the damper chamber 53 a back chamber 56 is provided where a spring 55 is arranged. The spring 55 tensions the damper membrane 54 into the desired position. Instead of the spring 55 the damper membrane 54 can also be maintained in the desired position by its inherent elasticity. The back chamber 56 is loaded through opening 57 with reference pressure. The reference pressure is advantageously ambient pressure. The feed line 50 extends through the pressure damper 36 up to the fuel valve 26.

The fuel valve 26 is connected by a relief line 58 with the fuel tank 32. In the relief line 58 a first valve 73 is arranged that, in the embodiment, is designed as a mechanically acting pressure limit valve. The first valve 73 has a valve member that is loaded by a spring. When the pressure upstream of the first valve 73 surpasses a predetermined actuating pressure, the first valve 73 will open. In this connection, the first valve 73 will open when an actuating pressure difference between fuel valve 26 and fuel tank 32 surpasses a constructively predetermined value that is defined by the spring of the first valve 73. When the pressure in the fuel tank 32 is greater than the pressure in the fuel valve 26, the first valve 73 remains closed. This can be the case when the fuel tank 32 is loaded with pressure. The first valve 73 blocks therefore a flow in the flow direction from the fuel tank 32 to the fuel valve 26. Flow of fuel from the fuel tank 32 to the fuel valve 26 is therefore prevented.

The fuel system has a conveying pump 69 which is arranged in the feed line 50 downstream of the control chamber 43 and upstream of the fuel pressure damper 36. The terms upstream and downstream relate in this context to the flow direction of the fuel in the fuel system. The conveying pump 69 is to be actuated manually by the operator. For this purpose, the conveying pump 69 has a pump bellows 77 that is also shown in FIG. 3. The interior of the pump bellows 77 is connected by means of an inlet valve 74 with the feed line 50. Instead, the pump bellows 77 can be connected by the inlet valve 74 directly with the control chamber 43. The inlet valve 74 opens in the flow direction toward the pump bellows 77. The conveying pump 69 has an outlet valve 75 that is arranged between the pump bellows 77 and the feed line 50 and opens in the flow direction from the pump bellows 77 into feed line 50. The flow path in which the inlet valve 74 is arranged branches off the feed line 50 upstream of the check valve 76 and the flow path in which the outlet valve 75 is arranged opens downstream of the check valve 76 into the feed line 50. The pump bellows 77 therefore constitutes a bypass that bypasses the check valve 76. The check valve 76 opens in flow direction from the control chamber 43 to the fuel pressure damper 36. The check valve 76 ensures that the pressurized fuel conveyed by the conveying pump 69 cannot flow from the feed line 50 back into the control chamber 43.

FIG. 5 shows the configuration of the holder 24, of the fuel pressure damper 36 and of the fuel valve 26 in detail. As shown in FIG. 5, the feed line 50 is delimited partially by the damper membrane 54 of the fuel pressure damper 36. The back chamber 56 of the pressure damper 36 has one or several connecting openings 63 which connect different areas of the back chamber 56 with each other. The opening 57 is covered by cover 64 that is air-permeable. The cover 64 is advantageously a screen, in particular a sintered metal screen.

The fuel valve 26 has a housing 67 in which a fuel chamber 62 is formed. The fuel chamber 62 has a metering opening 87 that is opened and closed by the fuel valve 26 embodied as an electromagnetic valve (solenoid valve) and that connects the fuel chamber 62 with the fuel passage 61 in the holder 24; the fuel opening 61 opens into the crankcase interior 31. As also shown in FIG. 5, the holder 24 has a seal 65 that seals the holder 24 relative to the crankcase 14. The fuel reaches through an inlet opening 66 the fuel chamber 62 in the housing 67. The inlet opening 66 is positioned in front of the section plane of FIG. 5 and is therefore indicated in dashed lines. Also, the connecting opening of the fuel chamber 62 with the relief line 58 is not positioned in the illustrated section plane. This connecting opening is not shown in FIG. 5.

Before starting the internal combustion engine 12, advantageously the conveying pump 69 is actuated by the operator by compressing the pump bellows 77 several times. Accordingly, the conveying pump 69 forces fuel through the feed line 50 into the fuel chamber 62 of the fuel valve 26. As soon as the actuating pressure difference is reached that is constructively predetermined by the first valve 73 upstream and downstream of the valve 73, i.e., between fuel chamber 62 and fuel tank 32, valve 73 opens and fuel flows through relief line 58 back into the fuel tank 32. The conveying pump 69 sucks in fuel through control chamber 43 of the pressure regulator 35 and through the fuel pump 34 from the fuel tank 32. The fuel that is conveyed by the conveying pump 69 primes the fuel system. Since the fuel is conveyed under pressure to the fuel valve 26, the function of the conveying pump 69 is not impaired by vapor bubbles that are possibly existing in the fuel chamber 62. The fuel pump 34 and the pressure regulator 35, as shown in FIG. 3, are arranged at a comparatively large spacing relative to the internal combustion engine 12 so that excessive heating and thus vapor bubble formation in these components are prevented.

Figure 6:
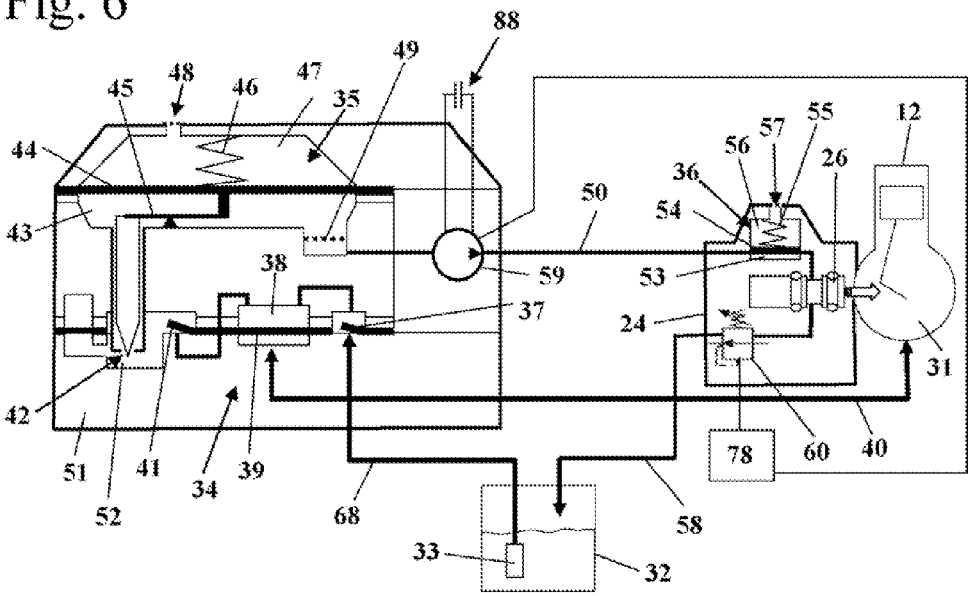
FIG. 6 is a schematic illustration of a first embodiment of the fuel system of the internal combustion engine.

FIG. 6 shows an embodiment of a fuel system in which instead of the manually actuated conveying pump 69 an electrically actuated conveying pump 59 is provided. The conveying pump 59 is connected to a power source 88 that is, for example, a battery or a battery pack of the cut-off machine 1, a generator driven by the internal combustion engine 12, or another energy source that supplies the internal combustion engine 12 with electric power. The conveying pump 59 is controlled by the electronic control unit 78 of the internal combustion engine 12. The electronic control unit 78 can control the operation of the conveying pump 59 based on actuating parameters, for example, as a function of an actuating pressure or an actuating pressure difference, as a function of an actuating temperature, for example, the temperature of the fuel valve 26 or of the internal combustion engine 12, as a function of an actuating engine speed of the internal combustion engine 12, or depending on time in such a way that the conveying pump 59 is running for a predetermined time span beginning with the start-up of the internal combustion engine 12. It can be provided that the conveying pump 59 reacts as a function of time to a pressure or a temperature. Also, a combination of the aforementioned parameters can be used for controlling the conveying pump 59. In usual operation, i.e., after completion of the starting procedure, after the engine 12 has reached operating temperature, after lapse of a predetermined operating time or the like, the first valve 60 is advantageously closed. The first valve 60, for example, can be closed also when the first combustion cycle of the internal combustion engine 12 after start-up has been detected, for example, by evaluating the engine speed course of the internal combustion engine 12.

In the embodiment according to FIG. 6, a first valve 60 is arranged in the relief line 58 and is in the form of an electrically actuated valve. The valve 60 is advantageously also controlled by the electronic control unit 78. The valve 60 can be controlled in particular as a function of an actuating pressure, in particular as a function of the pressure in the fuel chamber 62 or in the feed line 50. The valve 60 can also be controlled as a function of an actuating pressure difference between fuel chamber 62 and fuel tank 32. In this connection, the first valve 60 opens advantageously when a determined actuating pressure or a predetermined actuating pressure difference is surpassed so that the fuel pressure in the fuel system is limited. Also, a control as a function of an actuating temperature, in particular the temperature of the fuel valve 62, can be provided. In this connection, it is in particular provided that the valve 60 closes when the temperature of the fuel valve 26 has dropped below a predetermined temperature. This can be the case, for example, when the fuel valve 26 has been sufficiently cooled by priming with fuel. It can also be provided that the valve 60 is to be closed or opened as a function of an actuating engine speed of the internal combustion engine and/or by time control. Advantageously, the conveying pump 59 operates upon starting the internal combustion 12, i.e. at the time of start-up, to remove vapor bubbles that have formed in the fuel system, in particular in the fuel chamber 62 of the fuel valve 26. Upon starting, the conveying pump 59 advantageously is operating and the first valve 60 is open. In regular operation of the internal combustion engine 12, the fuel pump 59 is then switched off and the first valve 60 is closed. In case of electric control of the conveying pump 59 and of the valve 60 the conveying pump 59 and also the valve 60 can be used also for flushing the fuel valve 26 in operation. In this connection, advantageously the valve 60 is opened so that the fuel system is flushed with the fuel that is conveying by the fuel pump 34. The fuel pump 59 can be additionally operated in order to assist the fuel pump 34 that is driven by the fluctuating crankcase pressure when the fuel throughput through the valve 60 surpasses the pumping power of the fuel pump 34.

Figure 7:
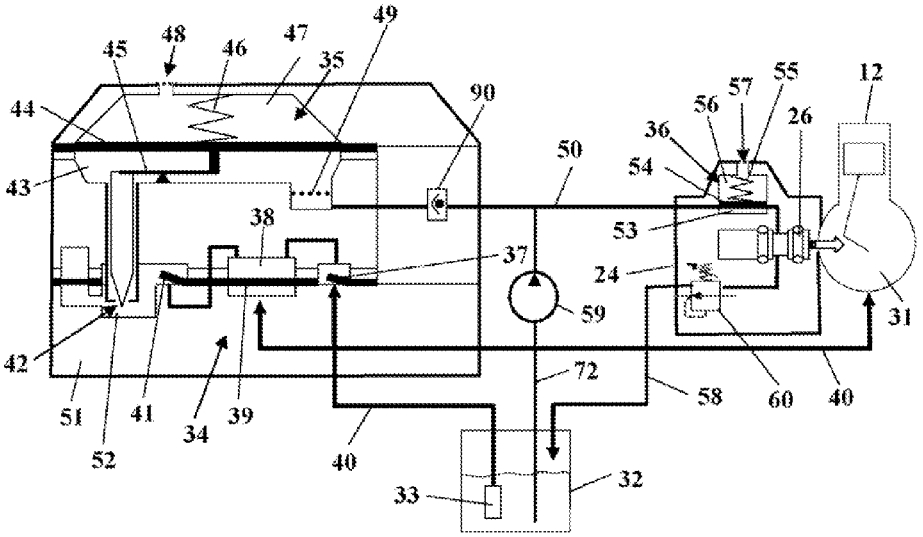
FIG. 7 is a schematic illustration of a second embodiment of the fuel system of the internal combustion engine.

In the embodiment according to FIG. 7, an electrically actuated conveying pump 59 as well as an electrically actuated first valve 60 are provided also. The conveying pump 59 and the valve 60, as already shown in FIG. 6, can be controlled by the electronic control unit 78, not illustrated in FIG. 7. The conveying pump 59 is arranged in the illustrated embodiment of FIG. 7 in a feed line 72 that connects the fuel tank 32 with the fuel chamber 62 in the fuel valve 26. The feed line 72 thus constitutes a bypass line bypassing the fuel pump 34 and the pressure regulator 35. In the feed line 50, upstream of the opening of the feed line 72 into the feed line 50, a check valve 90 can be provided. The check valve 90 prevents that the conveying pump 59 conveys fuel into the control chamber 43. The feed line 72 can be connected directly with the fuel chamber 62 instead.

Figure 8:
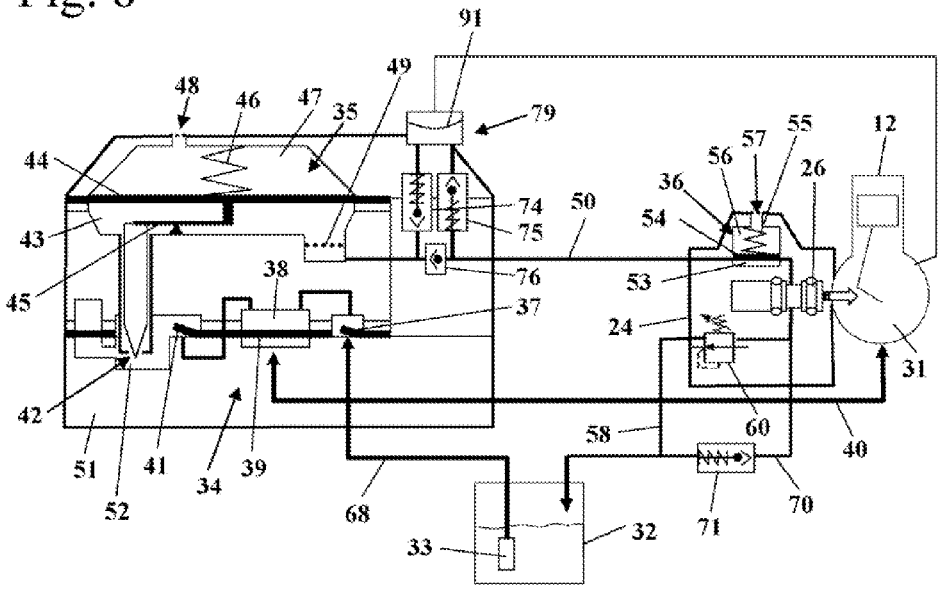
FIG. 8 is a schematic illustration of a third embodiment of the fuel system of the internal combustion engine.

In the embodiment according to FIG. 8, in the feed line 50 from the control chamber 43 to the fuel chamber 62 of the fuel valve 26 (FIG. 5) a conveying pump 79 is arranged that operates pneumatically. The conveying pump 79 is embodied in accordance with the manual conveying pump 69 and has an inlet valve 74, an outlet valve 75, and a check valve 76. Instead of the pump bellows 77 a membrane 91 is provided that has a back that is communicating with the crankcase interior 31 and therefore is loaded with the crankcase pressure so that the membrane 91 is moved as a function of the fluctuating pressure in the crankcase 31 and in this way conveys fuel to the fuel valve 26.

In the embodiment according to FIG. 8 a bypass line 70 bypassing the first valve 60 and the relief line 58 is provided. In the bypass line 70 a second valve 71 is arranged that in the illustrated embodiment is embodied as a mechanically acting pressure limit valve. The first valve 60 is advantageously controlled by the electronic control unit 78 (FIG. 3). Independent of the control of the first valve 60 the second valve 71 opens when the pressure difference between fuel valve 26 and fuel tank 32 surpasses a predetermined value. In this way, an impermissible overpressure at the fuel valve 26 can be prevented.

Figure 9:
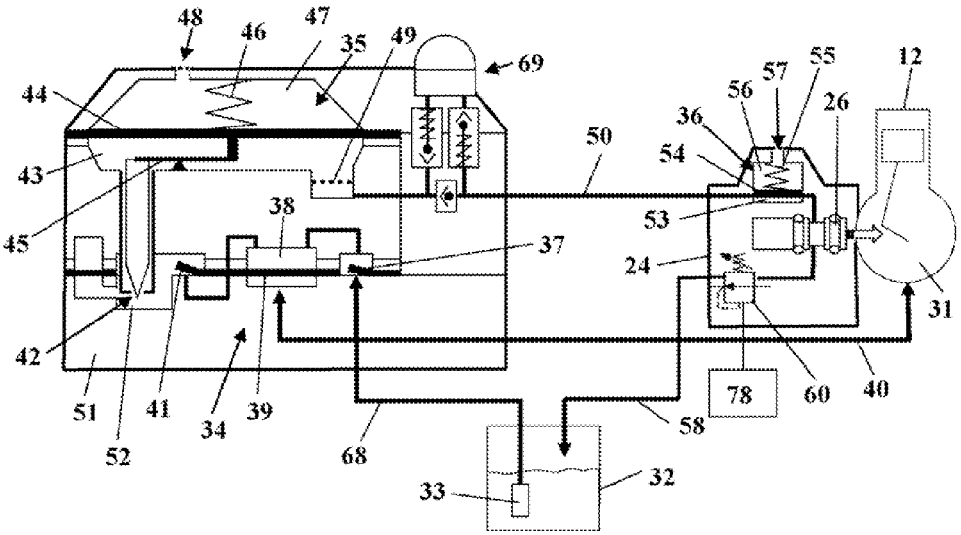
FIG. 9 is a schematic illustration of a fourth embodiment of the fuel system of the internal combustion engine.

In the embodiment according to FIG. 9 in the feed line 50 a conveying pump 69 is arranged that is to be manually operated and corresponds to the conveying pump 69 of FIG. 4. In the relief line 58 a first valve 60 is arranged that is controlled by the electronic control unit 78. By means of the first valve 60, for example, when starting the internal combustion engine 12, i.e., during the starting process, it can be ensured that the fuel valve 26 is primed. This is advantageously realized in that the operator actuates the conveying pump 69. When the operator does not actuate the conveying pump 69, the fuel is conveyed by the fuel pump 34. In this case, even for incorrect operation, i.e., when the conveying pump 69 is not actuated by the operator, start-up of the internal combustion engine 12 is enabled. However, upon incorrect operation more time is required for starting the engine because priming of the fuel system and of the fuel valve 26 takes more time.

Figure 10:
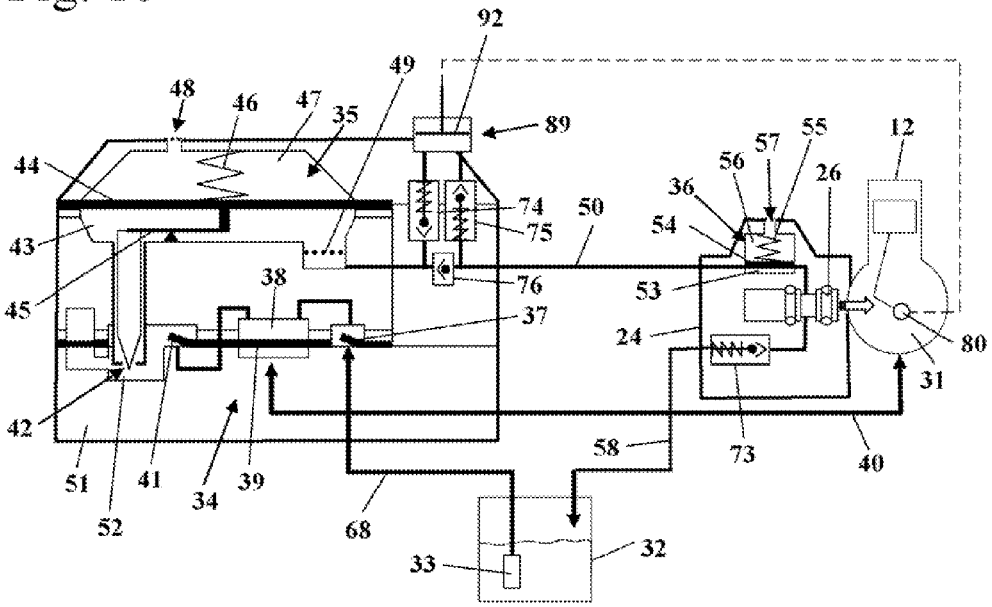
FIG. 10 is a schematic illustration of a fifth embodiment of the fuel system of the internal combustion engine.

In the embodiment according to FIG. 10, a conveying pump 89 is provided in the feed line 50 that is driven mechanically by the crankshaft 80 of the internal combustion engine 12. The conveying pump 89 has, like the manual conveying pump 69, an inlet valve 74, an outlet valve 75, and a check valve 76. Instead of the pump bellows 77, a piston 92 is provided which is reciprocated by the crankshaft 80. This can be done, for example, by means of cam control. Coupling of the rotational movement of the crankshaft and of the reciprocating movement of the piston 92 can be done in any known suitable way. Advantageously, the rotational movement of the crankshaft 80 is coupled by a clutch to the piston 92 so that the conveying pump 89 is disengaged upon opening of the clutch. In the embodiment according to FIG. 10, a valve 73 is arranged in the relief line 58 and is embodied as a mechanical pressure limit valve.

In the illustrated embodiments, different combinations of conveying pumps and valves in the relief line are shown. The illustrated combinations are to be understood only as examples and are not limiting. All illustrated conveying pumps can be combined in any combination with any of the illustrated arrangements of the conveying pump and with any of the illustrated valve arrangements.

The pressure in the fuel system downstream of the fuel pump is advantageously minimal in all embodiments and is only a few bar or only one or several tenths of a bar above the ambient pressure. Advantageously, the pressure is in the magnitude of approximately 100 mbar above ambient pressure.

The specification incorporates by reference the entire disclosure of German priority document 10 2011 120 465.6 having a filing date of Dec. 7, 2011.

While specific embodiments of the invention have been shown and described in detail to illustrate the inventive principles, it will be understood that the invention may be embodied otherwise without departing from such principles.

What is claimed is:

1. An internal combustion engine comprising:

a fuel system comprising:

a fuel valve with a housing, wherein in the housing a fuel chamber is formed;

a fuel tank;

a fuel pump comprising a pump chamber and pumping fuel from the fuel tank into the fuel chamber;

a pressure regulator comprising a control chamber, wherein the pressure regulator is arranged in a flow path of the fuel in a flow direction from the pump chamber to the fuel chamber of the fuel valve;

a conveying pump adapted to provide forced conveyance of fuel into the fuel system;

a feed line connecting the control chamber of the pressure regulator with the fuel chamber of the fuel valve, wherein the conveying pump is arranged in the feed line so that the pressure regulator does not limit a fuel pressure generated by the conveying pump in the fuel chamber of the fuel valve when the conveying pump supplies fuel to the fuel chamber;

a relief line connected to the fuel chamber of the fuel valve;

a first valve arranged in the relief line.

2. The internal combustion engine according to claim 1, wherein the feed line is a bypass line bypassing the fuel pump and connecting the fuel tank to the fuel chamber.

3. The internal combustion engine according to claim 1, wherein the first valve is actuated as a function of an actuating pressure.

4. The internal combustion engine according to claim 3, wherein the actuating pressure actuating the first valve is a pressure in the fuel chamber.

5. The internal combustion engine according to claim 3, wherein the actuating pressure actuating the first valve is a pressure difference between the fuel chamber and the fuel tank.

6. The internal combustion engine according to claim 1, wherein the first valve is actuated as a function of an actuating temperature.

7. The internal combustion engine according to claim 1, wherein the first valve is actuated as a function of an actuating engine speed of the internal combustion engine.

8. The internal combustion engine according to claim 1, wherein the first valve is actuated by time control.

9. The internal combustion engine according to claim 1, wherein the first valve is actuated as a function of an actuating pressure and is a pressure retention valve opening in a relief direction of the relief line.

10. The internal combustion engine according to claim 9, wherein the first valve blocks in a direction opposite to the relief direction.

11. The internal combustion engine according to claim 1, wherein the first valve is actuated as a function of an actuating pressure and is an electrically actuated valve.

12. The internal combustion engine according to claim 11, further comprising an electronic control unit actuating the first valve.

13. The internal combustion engine according to claim 11, wherein the fuel system further comprises a second valve arranged in a bypass line bypassing the first valve.

14. The internal combustion engine according to claim 13, wherein the second valve is a pressure retention valve.

15. The internal combustion engine according to claim 1, wherein the conveying pump is manually operated.

16. The internal combustion engine according to claim 1, wherein the conveying pump is mechanically driven by a component of the internal combustion engine.

17. The internal combustion engine according to claim 1, wherein the conveying pump is electrically driven.

18. The internal combustion engine according to claim 1, wherein the conveying pump is pneumatically driven.

* * * * *